US005725120A

United States Patent [19]

Ramsey et al.

[11] Patent Number: 5,725,120

[45] Date of Patent: Mar. 10, 1998

[54] CONTAINERS

[75] Inventors: Christopher Paul Ramsey, Wantage; Graham Martin Gossedge, Didcot, both of United Kingdom

[73] Assignee: Carnaudmetalbox (Holdings) USA, Inc., Wilmington, Del.

[21] Appl. No.: 442,113

[22] Filed: May 16, 1995

[30] Foreign Application Priority Data

May 21, 1994 [GB] United Kingdom ..... 9410228

[51] Int. Cl.[6] ..... B65D 17/40

[52] U.S. Cl. ..... 220/276; 220/609; 220/359

[58] Field of Search ..... 220/609, 276, 220/203.01, 359

[56] References Cited

U.S. PATENT DOCUMENTS

| | | | |
|---|---|---|---|
| 1,627,042 | 5/1927 | Mason et al. . | |
| 3,208,627 | 9/1965 | Lipske | 220/276 |
| 5,105,977 | 4/1992 | Taniuchi | 220/276 |
| 5,246,134 | 9/1993 | Roth et al. . | |
| 5,353,943 | 10/1994 | Hayward | 220/276 |

FOREIGN PATENT DOCUMENTS

| | | |
|---|---|---|
| 0357276 | 8/1989 | European Pat. Off. . |
| 0357123 | 8/1989 | European Pat. Off. . |
| 0412272 | 6/1990 | European Pat. Off. . |
| 0408268 | 7/1990 | European Pat. Off. . |
| 2609525 | 3/1976 | Germany . |
| 655072 | 4/1983 | Switzerland . |
| 2177371 | 3/1986 | United Kingdom . |
| WO-A91/07325 | 11/1990 | WIPO . |
| WO93/12978 | 12/1992 | WIPO . |

*Primary Examiner*—Joseph M. Moy
*Attorney, Agent, or Firm*—Diller, Ramik & Wight, PC

[57] ABSTRACT

A lid 1 for a container body 8 having a side wall 7 portion at one end of which an annular portion 9 extends at an obtuse angle to the side wall to define the mouth of the container. The lid has an elastically deformable central panel 2 and a peripheral annular flange 3 which extends downwardly and outwardly from the central panel to define a seal surface to co-operate with the annular portion 9 of the body. When adhered or fused together the inclined portion of the lid and body receive the stress, arising as a thermal processing increases the volume of product packed, as a load in shear peel force being minimized.

30 Claims, 5 Drawing Sheets

CONTAINERS

BACKGROUND OF THE INVENTION

This invention relates to lids and containers having a side wall terminating in an annular portion defining the mouth of the container which is closed by a closure member the periphery of which is bonded to the annular portion.

Our British Patent 1361415 describes cans in which a flat diaphragm is clinched between a curled rim and inward bead of the side wall. Opening was achieved by cutting the diaphragm.

Our British Patent 2237259 describes and claims a metal container body having a side wall to which is attached a metal ring defining the mouth of the container. A closure member in the form of a flat disc of coated foil is bonded to flat abutting portions of the ring. The closure member is opened by cutting the foil or peeling the foil from the ring.

Our British Patent 1601368 describes and claims a can body comprising a cylindrical side wall made by bending a rectangular metal blank to a cylinder, welding the adjacent edges and curling one end of the cylinder. A paper laminate diaphragm is adhered to the curled rim of semi-circular cross section. Both these later containers give a risk that a flat closure member will peel from the bond of the ring of the container if subjected to internal pressure.

U.S. Pat. 5,246,134 (Polystar) describes a metal can body with a ring of plastics material fitted over an outward curl of the side wall of the can. A lid is peelably bonded to the plastics ring. An inner annulus of the plastics ring is flexible to bend as pressure develops during thermal processing of the contents of the lidded can. A disadvantage of this arrangement arises because the polymer used for the ring is expensive.

SUMMARY OF THE INVENTION

This invention provides, in combination, a lid of polymeric material and a metal container body having side wall portion at one end of which an annular portion extends from the side wall to define a mouth of the container, said lid comprising a centre panel surrounded by a peripheral annular flange which extends outwardly and axially towards the side wall to define a seal with the annular portion of the side wall; characterised in that, the lid is made of an elastic barrier plastic material so that the lid may deform elastically during thermal processing and return to its original shape after thermal processing.

The peripheral annular flange of the lid is inclined at an obtuse angle between 95° and 175° to an axis extending perpendicular to the central panel in order to co-operate with the annular portion of the side wall.

And the lid has a shape to permit a 10% increase in volume of the lidded container during thermal processing in order limit increase in pressure in the container to no more than 5 psi.

In preferred embodiments the angle between the annular flange of the lid and an axis extending perpendicular to the central panel portion is in a range between 120° and 150°.

In a first embodiment the annular portion of the side wall is an inwardly directed margin of side wall material.

In a second embodiment the annular portion of the side wall is an inwardly directed margin of side wall material formed to terminate in an outwardly directed crushed curl.

In a further embodiment the annular portion of the side wall is an upper surface of an annular bead formed in the side wall and the free edge of the side wall terminate in an outwardly directed curl.

In alternative embodiments, the annular portion of the side wall is on a metal ring attached to the side wall; or the annular portion of the side wall is a ring of plastics material clinched or adhered to the metal side wall portion.

In a preferred embodiment the annular portion of the side wall is an outwardly directed flange supported by a neck of reduced diameter formed at the end of the side wall portion. If desired, the outwardly directed flange of the body may terminate in an inwardly directed curl.

The seal between the peripheral flange of the lid and annular portion of the body is preferably a peelable seal. A pull-tab may extend laterally from the flange of the lid.

The lid is preferably made from a laminate of several layers of plastics materials to achieve a desired barrier plastics material, however less stringent storage requirements may permit use of a single layer of plastics material, such as polypropylene or polyethylene, as lid material.

When a barrier plastics material is required, a laminate of polypropylene/adhesive/ ethylene-vinyl-alcohol/adhesive/ polypropylene or the like may be used.

In order to permit elastic expansion during thermal processing, the lid may have a flat central panel surrounded by a flexible channel portion which joins the centre panel to the peripheral flange of the lid. Alternatively, the centre panel of the lid may be, in cross-section, a segment of a circle spanning the peripheral flange of the lid so that expansion of volume is achieved as pressure in the container increases, as the contents are heated, to progressively evert the centre panel.

The central panel may be made flexible by virtue of its thickness and material such as polymer sheet or by means of concentric flexible beads as is used in metal can ends or both. A benefit of using concentric beads is that volume expansions of the order of 10% of the container volume as filled are possible. This reduces the differential pressure in a saturated steam retort at 131° C. from typically 30–40 psi down to 2–5 psi thus allowing a peelable seal to be used.

Various embodiments will now be described by way of example and with reference to the accompanying drawings in which:

DESCRIPTION OF THE PREFERRED EMBODIMENTS

Figure 1:
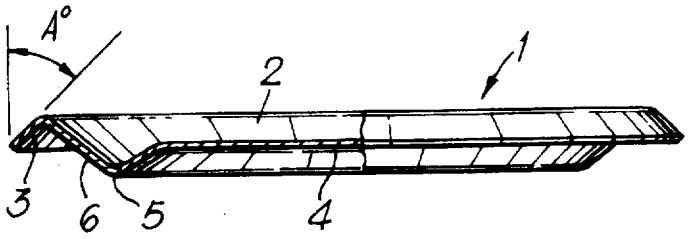
FIG. 1 is a side view a first embodiment of the lid cut-away on a diameter.

FIG. 1 shows a first embodiment of the lid 1 comprising a dished central panel 2 surrounded by a peripheral flange 3 which extends outwardly and downwardly to surround the centre panel. As shown in FIG. 1 the peripheral flange is substantially frustoconical with an included angle of about 90° which gives an angle A to a central axis perpendicular to the central panel of about 45°. However angles to this central axis may be between 5° and 85° preferably between 30° and 60°.

The central panel comprises a flat centre panel 4 surrounded by an annular channel portion 5 the outer wall 6 of which joins the peripheral flange 3.

Figure 2:
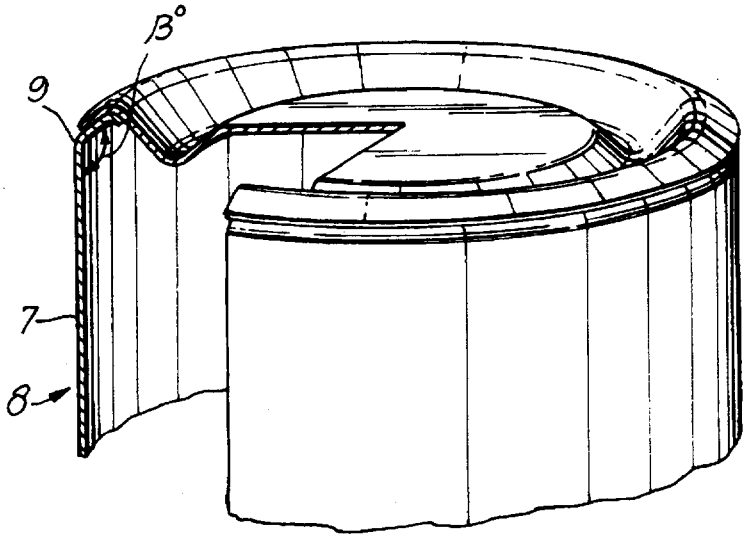
FIG. 2 is a perspective sketch of the lid of FIG. 1 bonded to a container body.

FIG. 2 shows the lid 1 fitted on the side wall 7 a can body. The side wall has an inturned rim 9 extending from the rest of the side wall at an obtuse angle B° of about 135° so that the flange 3 of the lid rests on the inturned flange 9 of the body to permit bonding together.

The bond may be a permanent bond such as can be achieved by adhesive or fusion of polymer coatings on the lid and body or alternatively a peelable bond may be a achieved by use of appropriate coatings or surface layers of lid and body.

During thermal processing of the contents of the lidded can body the central portion 2 of the lid distends outwardly as the contents of the can expand, but by virtue of the angled flanges of lid and body, the bond is not put into a peel mode of loading so use of peel seals is possible. When a peelable seal is used the lid 1 may be used to reclose the can 8.

In this first embodiment as shown in FIGS. 1 and 2 the can body 8 is preferably made from sheet metal provided with known surface coatings. The lid is preferably vacuum formed from a sheet of laminated barrier plastics material with or without a layer of aluminium foil. The flange of the lid is bonded by adhesive to the body flange 9.

Figure 3:
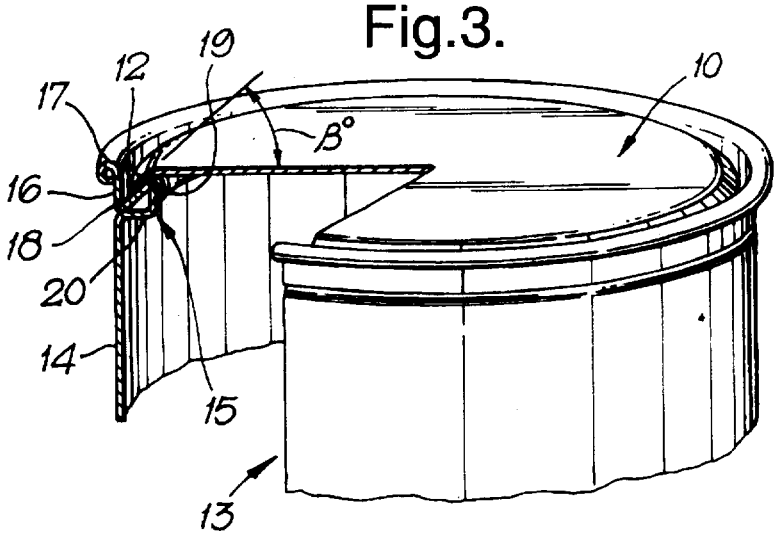
FIG. 3 is a perspective sketch of a second embodiment of the lid when bonded to another can body.

FIG. 3 shows a second embodiment of the lid and container in which the lid 10 comprises a flat central panel 11 from the periphery of which depends a peripheral annular flange 12 which is inclined to an axis perpendicular to the flat central panel at an angle of about 30°.

The lid 10 may be made of thin sheet metal or a laminate of barrier plastic materials, with or without an aluminium foil layer, flexible to distend elastically during thermal processing.

In FIG. 3 a can body 13 made from sheet metal, has a substantially cylindrical side wall 14 comprising an annular inwardly directed bead 15 connecting the side wall 14 to a side wall margin 16 above the bead. The side wall margin terminates in an outwardly directed curl 17. As shown, the inwardly directed bead has three portions; an upwardly and radially inwardly inclined surface 18 extending from the side wall margin, an upright wall 19 extending from the inclined surface towards the interior of the container, and an annular portion 20 extending from the upright portion to the side wall. The inclined surface 18 makes an angle B° to the central axis of the can of 60° or an obtuse angle of 120° to the side wall 14 so that the flange of the lid and inclined surface are contiguous to provide a useful area for bonding. The side wall margin 16 serves to protect the bond from abuse. When the lids shown in FIGS. 2 and 3 are permanently bonded to the inclined surface of their can bodies the opening is achieved by cutting the lid with a knife. When a peelable seal is used the lids may be peeled from the inclined surfaces to that the lids may be used to reclose their can bodies.

Figure 4:
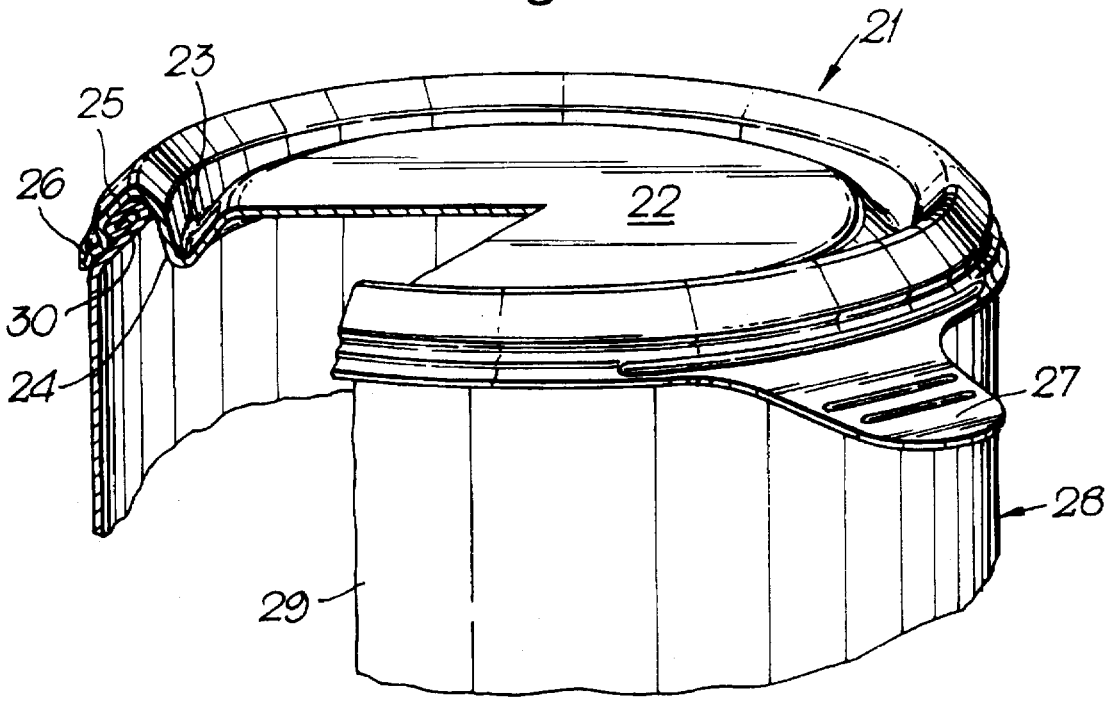
FIG. 4 is a perspective sketch of a third embodiment of the lid when fitted on a curled rim of a container body.

FIG. 4 shows a third embodiment of the lid and can body. The lid 21 is thermoformed from a sheet of barrier plastics to comprise a flat centre panel 22 a channel 23 the outer wall 24 of which connects with a peripheral flange 25 inclined to an axis perpendicular to the flat centre panel at an angle of about 45° surrounded by a stepped short portion 26 having a lateral lug 27. A benefit arising from use of the channel portion arises because the channel is able to flexibly bend to raise the centre panel so increasing the container volume by as much as 10% during thermally induced expansion of a product in the can so controlling the pressure differential in a saturated steam retort at 131° C. from typically 30 to 40 psi to 2 to 5 psi so permitting a peelable seal to be used.

In FIG. 4 the can body 28 has a side wall 29 terminating in a crushed curl 30 the upper surface of which gives a bond area inclined to the side wall at an angle to co-operate with the flange of the lid for bonding by a peelable seal. The crushed curl gives a stiff rim to define the mouth of the can.

During thermal processing expansion of the contents of the can body 28 is accommodated by distention of the flat panel 22 and channel 23 so that little or no peel force is put on the peelable seal. If the panel deformation becomes the sufficient to pull the channel to a convex continuum the load on the inclined bonded surfaces is in shear, not peel.

Figure 5:
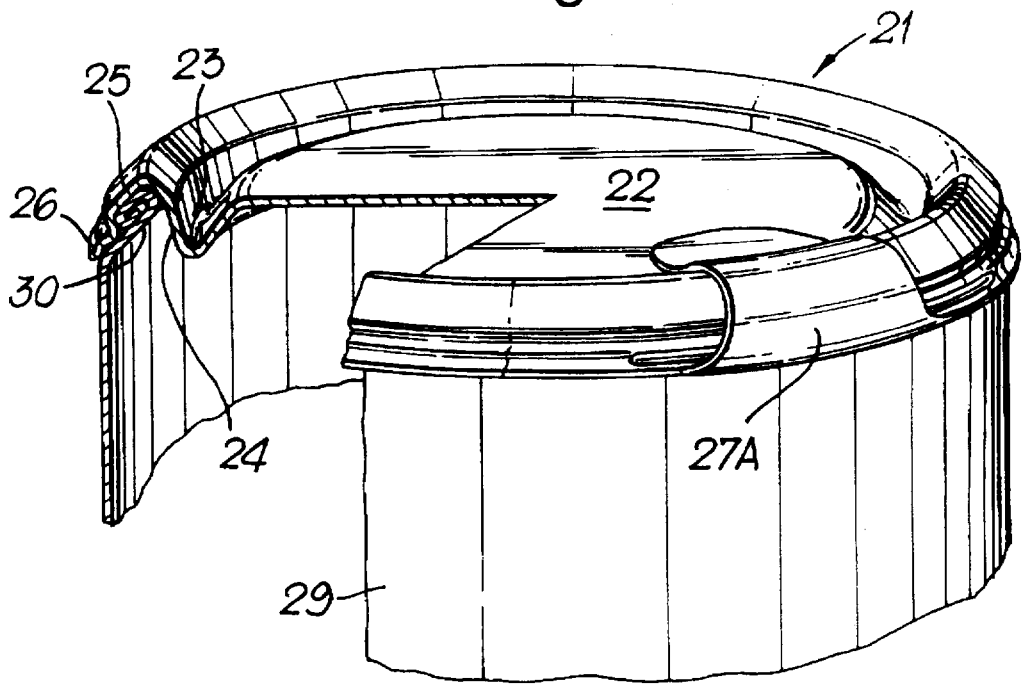
FIG. 5 is a like view to FIG. 4 but with the lid tab bent back on itself.

FIG. 5 shows the can and lid of FIG. 4 but with the lateral lug 27 a bent back on itself over the channel portion. This arrangement may be preferred if the lidded cans are placed on pallets and busse packed for distribution. Furthermore the bent back tab may be joined by a frangible weld to the inclined surface or top of the lid as a tamper-evident feature.

Figure 6:
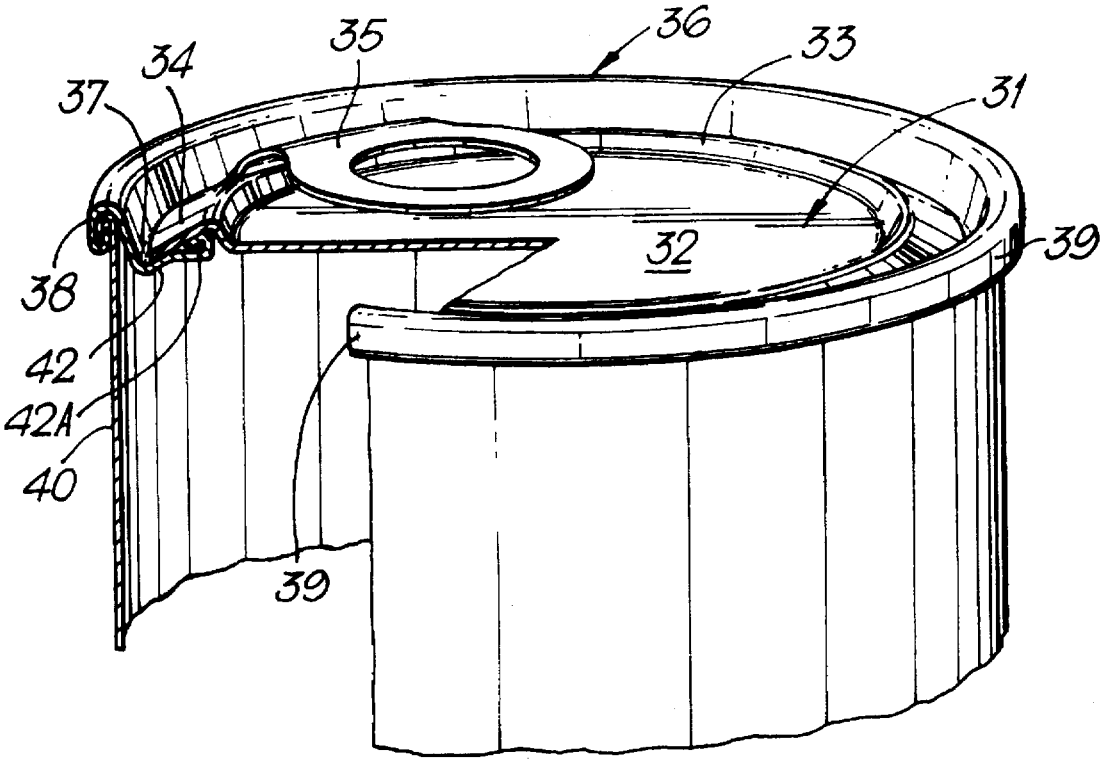
FIG. 6 is a perspective sketch of a fourth embodiment of the lid on a metal ring of the container body.

FIG. 6 shows a fourth embodiment of the lid and can body in which the lid 31 has been thermoformed from a sheet of barrier plastics to comprise a flat centre panel 32, an annular wall 33 upstanding from the periphery of the centre panel, and an inclined peripheral flange 34 provided with a pull lug 35 bent over the centre panel to lie flat.

The peripheral flange 34 is bonded to a ring of metal comprising an annular inclined surface 42 to which the peripheral flange is bonded, a chuck wall portion 38 upstanding from the lower edge of the inclined surface, and a seam portion 38 folded into the double seam 39 which connects the ring to a side wall 40 of a can body. The inclined surface 42 is in the form of a frustoconical annulus of metal the inner edge of which is curled back on itself so that the raw edge and upper part of the curl 42A are aligned with the lower outer portion 42 to present a smooth frustoconical surface to the flange of the lid. As shown in FIG. 6 the curl is triangular in cross section.

Figure 7:
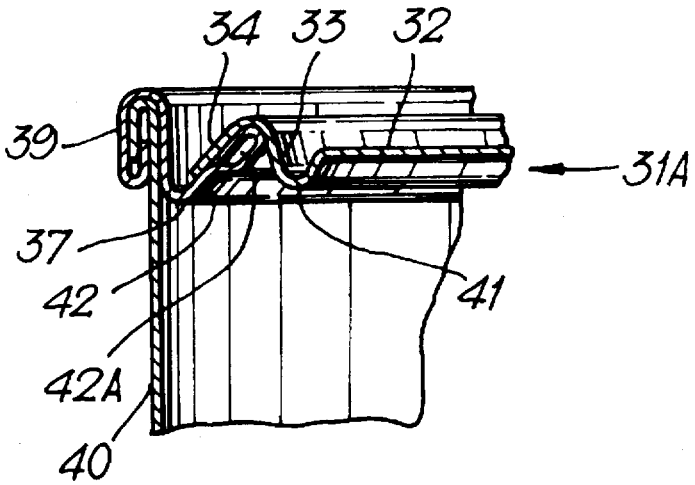
FIG. 7 is a fragmentary cross section of the ring and lid of FIG. 6.

As shown in FIGS. 6 and 7 the flange of the lid covers the curl free edge so that bonding of the lid to the ring protects the free edge from corrosion by the product packed or the storage environment. In FIG. 6 the lid panel distends to accommodate increased pressure in a closed can by elastic deformation or bulging of the centre panel 32 and pulling in of material of the wall 33.

In FIG. 7 the lid 31A is provided with an annular channel portion 41 which joins the flat centre panel 32 to the peripheral flange 34 which is inclined at about 120° to the side wall 40. As shown in FIG. 7 the curl 42A is flattened to a fold.

One advantage of using this metal ring 36 that the double seam protects the peelable bond of lid and inclined flange surface, from abuse during transit and stacking. If desired the ring may be made of thin metal so that it is inherently flexible to bend upwards to align with tensile forces arising in a distending lid so that peel forces do not develop at the bond between the lid and ring. However, flexibility of the metal ring is made less important by inclining the inclined surfaces 42, 42A of the ring and flange 34 of the lid at an angle expected to put the bond in shear during periods of maximum distention of the lid during thermal processing.

Figure 8:
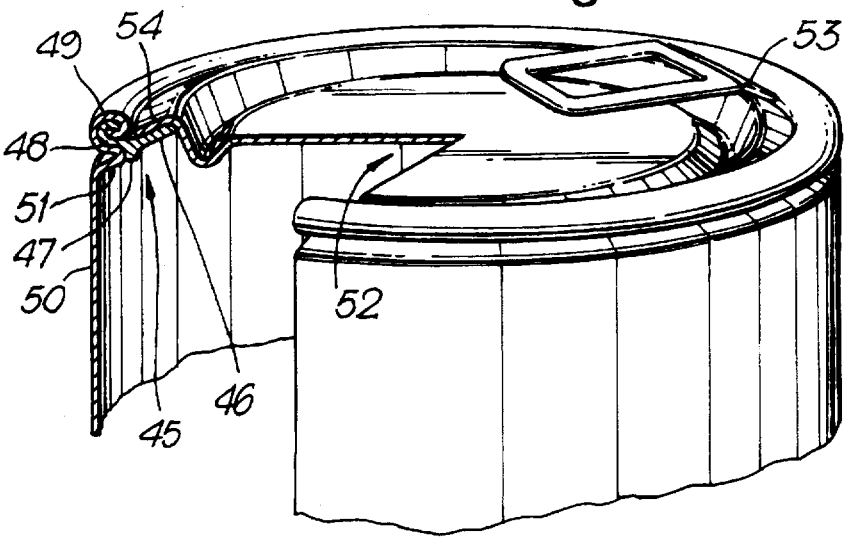
FIG. 8 is an enlarged fragmentary section of the ring of FIG. 8 at a pull tab.
Figure 9:
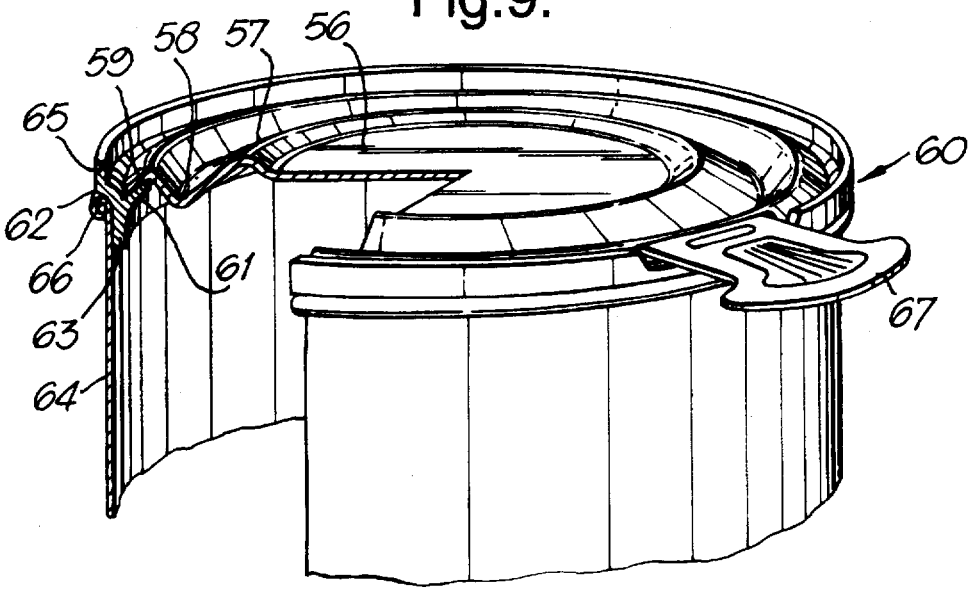
FIG. 9 is a perspective view of a sixth embodiment in which the lid is bonded to a plug of plastics material which is bonded to the side wall of a can body.

FIGS. 8 and 9 show containers in which the lid is connected to the side wall of the container by a ring of thermoplastics material.

In FIG. 8 the plastics ring 45 comprises an inclined annular portion 46, an annular rib 47 depending from the inclined portion, and a peripheral flange 48 engaged in the curl 49 of the side wall 50 of a can body. Entry of the peripheral flange into the body is limited by an inwardly directed bead 51 in the side wall 50 of the container body so that tight curling of the free edge of the side wall to the curl 49 compresses the peripheral flange 48 against the inwardly directed bead 51 to achieve an hermetic seal.

The lid 52 of FIG. 8 is similar to that used in the first and second embodiments except that the pull tab 53 is made separately from the lid and bonded or welded to the inclined surface 46 of the lid. This separately moulded pull tab can be made thicker than the lid so it is comfortable to grip but made of a cheaper mono-polymer, such as polyethylene, or polypropylene so that a large pull tab may be used without shred-scrap loss in the expensive barrier plastic sheet used for the lids.

Figure 8A:
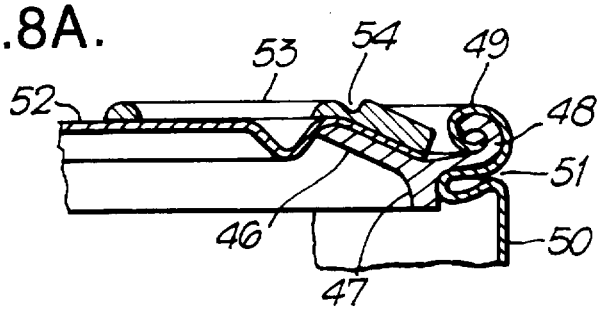
FIG. 8A is a perspective sketch of fifth embodiment of a lid on a ring of plastics material crimped to the can body.

FIG. 8A shows the pull tab bonded to the lid insitu on the plastics ring clinched to a can body. It will be noticed that the tab 53 is thicker than the lid material 52 and bonded to the inclined surface of the lid. A notch 54 in the pull tab enables the user to lift the tab before pulling so that the lid 52-to-ring bond at surface is subjected to a peel force during opening.

FIG. 9 shows a modified form of lid 55 comprising a flat centre panel 56, an outwardly convex expansion bead 57 surrounding the centre panel, an outwardly concave bead 58 surrounding the convex bead, and a peripheral flange 59 inclined at about 45° to an axis perpendicular to the flat centre panel.

A plastics ring 60 comprises an inclined portion 61 extending at about 45° to a stepped cylindrical portion 62 which extends above and below the inclined portion. The lower portion 63 of the cylindrical portion is a plug fit in container body 64. The upper portion 65 of the cylindrical portion is of wider external diameter than the lower portion to limit entry into outwardly curled rim 66 of the body and arises to a height above the lid 55 and pull tab.

The pull tab 67 extends laterally through a gap in the upper portion 65 so that like containers can be stacked with their weight resting on the upper portion and rim, no weight being put on the pull tab.

The pull tab 67 may alternatively be made of a relatively thick moulding which is joined by welding to a lateral extension of the lid flange 59.

Figure 10:
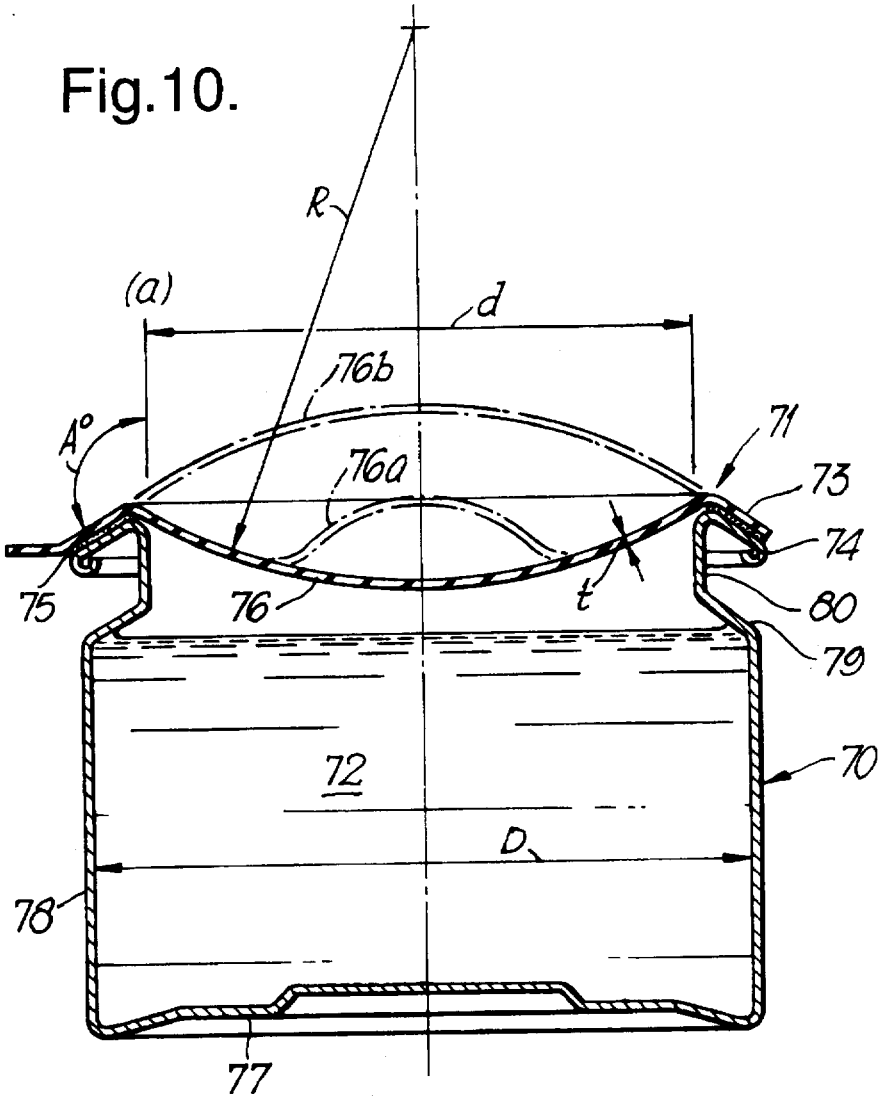
FIG. 10 is a sectioned side view of a filled and lidded container.

FIG. 10 shows a container body 70 drawn from sheet metal and closed by a dished lid 71 of polymeric material. As shown in FIG. 10, the container is filled with a product 72 so that as the lidded container and product are heated during thermal processing the product expands to increase pressure in the container. Under the influence of heat and increased pressure the lid 71 of polymeric material starts to bulge in the middle and develops complete eversion (shown dashed) to increase the volume of the lidded container by about 10% so abating internal pressure and preventing development of a peel force on the seal between the annular flange 72 of the lid and annular portion of the body 74. Avoidance of peel forces on the seal permits use of a peelable seal 75 between the lid and annular portion so a consumer will find the container easy to open by peeling the lid from the can.

Figure 11:
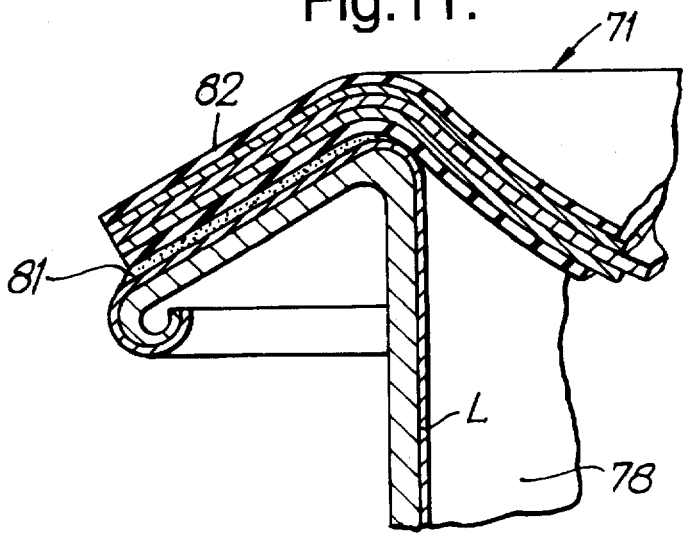
FIG. 11 is a fragmentary section of an alternative lidding material and body.

The lids may be made from single layer of polymeric film or a multi-layer film may be used to achieve greater barriers to coater vapour and oxygen. For example the single film may be polypropylene, or polypropylene copolymer with, for example ethylene. A barrier plastic material 87 in the form of extruded sheet and comprise polypropylene/adhesive/ethylene/vinyl/alcohol (EVOH)/adhesive/polypropylene (as shown in FIG. 11) or polypropylene/nylon/laminates. The inter film adhesive layer of the lid is typically a maleic hydride modified polypropylene. The thickness of lid material may be between 200 and 600 um but preferably in a range 300 to 400 um. The lids of FIGS. 10 and 11 are made by thermoforming the chosen lid material.

In FIG. 10 the lid is shown before excess pressure develops in the container. The lid comprises an outwardly concave centre panel 76 having a shape which is a segment of a circle of radius R, and a peripheral flange depending from the panel at an obtuse angle A° to the vertical axis (a) perpendicular to the centre of the lid. The angle A° is between 95° and 175° preferably between 120° and 150°. In FIG. 10 angle A° is about 120°.

The container body of FIG. 10 has a bottom wall 77 and a side wall 78 of diameter D upstanding from the periphery of the bottom wall. The side wall 78 is reduced in the diameter as its free end to make a shoulder 79, cylindrical diameter of neck 80 and outwardly directed annular portion which terminates in a peripheral inwardly directed curl which serves to stiffen the annular portion. The annular portion is inclined to the axis (a) at the same angle A° as the lid flange so that lid flange and body portion fit together to permit sealing. The interior surface of the container body may be coated with lacquer or other film.

In FIG. 10 sealing of the body and lid is by means of an adhesive 75 which bonds the metal can body to the polymeric lid. The seal adhesive is comprised of polypropylene or polypropylene polymers chemically modified to increase the level of polar groups. Typically maleic carbonhydride is used to modify the polypropylene. The adhesive is preferably FDA approved.

FIG. 11 shows on enlarged scale a fragment of a preferred lid of barrier plastics material on an inclined annular portion of a can body generally as shown in FIG. 10. In this example the lid of barrier plastics material is bonded by an adhesive 81 applied as a powder to a lacquer coating on the can interior and flange. In this example details are tabulated:

Lid material =polypropylene/adhesive/EVOH/ =adhesive/polypropylene
Lid thickness t =400 um
Lid: panel concave radius R =62.1 mm
Lid and flange angle A° =120°
Lid panel/neck diameter "d" =72 mm
Lidded volume change when concave lid everted =36.9 mls
Seal adhesive =Maleic anhydride modified polypropylene
Container body =tinplate
Container coating "L" =epoxy based lacquer A lid was applied to each can body and heat was applied by means of an induction coil which generated sufficient heat at the sealing surface interfaces to soften and melt the seal adhesive thereby enabling polar groups to function as adhesion promoters.

Lacquer and adhesive materials are selected by lap and shear bond tests at 131° C. using an Instrom Tensometer at a cross head space of 25 mm/min. Bond strengths in excess of 300N per 2.5 mm strip were obtained for a 10 mm overlapped joint in test specifications.

Filled cans, lidded as described above, were thermally processed in a "Lagarde Retort Simulator" simulating a food processing cycle as occurs in a commercial apparatus such as the "HYDROSTAT" process. Conditions of process were:

Come-up Time =15 mins
Process Time =75 mins
Process Temp =121° and 131° C.
Pressure during process =1.2 bar
Cooling Time =30 mins During this prolonged period of heating and cooling it was observed that the original concave shape of the lid everted from its concave arcuate cross section to bulge as a convex form 76*a*, 76*b* in which the peripheral surface of the centre panel is substantially aligned with the peripheral flange sealing bond and container body flange so that during high pressure arising during processing the bond is on shear mode of loading, not a peel mode.

If higher process pressures are anticipated, and greater container volume compensation is desired, it may be necessary to increase the angle A° of annular portion, bond, and lid flange to, for example 95°.

This invention includes permanent bonds of the lid to the inclined body or ring surface such as can be achieved by fusing polymer surfaces of the lid and inclined surface. The invention also includes use of peelable bonds between the lid and inclined surface such as can be achieved by coating at least one of the lid or inclined surface with a peelable material such a copolymer. One example of a lid material 71 comprising barrier layers and copolymer seal layer is a laminate of polypropylene/ adhesive/EVOH/adhesive/ copolymer of polypropylene and polyethylene. Typically this laminate would be between 0.4 and 0.7 mm thick with the ethylene vinyl alcohol (EVOH) constituting about 10% of thickness.

The container bodies described are all made from sheet metal. The container may be made from a rectangular blank by rolling a blank to a cylinder, which is seamed by welding or fusion, and closed at one end by double seaming an ordinary can end. This built up technique is also used for rectangular or square tins. Alternatively the container body may be made by deep drawing a blank of metal to make a seamless container. In both cases the inclined surface, and rim if present, may be formed by roll forming with or without die forming.

Although a preferred embodiment of the invention has been specifically illustrated and described herein, it is to be understood that minor variations may be made in the apparatus without departing from the spirit and scope of the invention, as defined the appended claims.

We claim:

1. A thermally processable container which is subject to elevated pressures during processing comprising a lid (1, 10, 21, 31, 31A, 52, 55, 71) and a metal container body (8, 13, 28, 40, 70), said metal container body (8, 13, 28, 40, 70) having a side wall portion (7, 14, 29, 50, 64, 78) from one end of which extends an inclined annular portion (9, 18, 30, 42, 46, 61, 74) defining a mouth of the container body (8, 13, 28, 40, 70), said lid (1, 10, 21, 31, 31A, 52, 55, 71) comprising a generally transversely extending central panel portion (2, 11) surrounded by a downwardly inclined peripheral annular flange (3, 12, 25, 34, 54, 59, 72) which is bonded to said inclined annular portion (9, 18, 30, 42, 46, 61, 74) of the side wall so as to form a seal therewith, said annular flange (3, 12, 25, 34, 54, 59, 72) of said lid (1, 10, 21, 31, 31A, 52, 55, 71) being inclined at an angle of between 5° and 85° to the central panel portion (2, 11) in order to cooperate with the inclined annular portion (9, 18, 30, 42, 46, 61, 74) of the side wall;

the central panel portion (2, 11) being upwardly deformable during thermal processing and returned to its original shape after thermal processing; and the upward deformation of said central panel portion (2, 11) during thermal processing effects a 10% increase in volume of the lidded container so as to limit increase in pressure in the container to no more than 5 p.s.i.

2. The thermally processable container and lid as defined in claim 1 wherein the angle between the annular flange (3, 12, 25, 34, 54, 59, 72) of the lid (1, 10, 21, 31, 31A, 52, 55, 71) and an axis extending perpendicular to the central panel portion (2, 11) is in a range substantially between 120° and 150°.

3. The thermally processable container and lid as defined in claim 1 wherein said inclined annular portion (9, 18, 30, 42, 46, 61, 74) is inwardly upwardly inclined.

4. The, thermally processable container and lid as defined in claim 1 wherein said inclined annular portion (9, 18, 30, 42, 46, 61, 74) in part defines an outwardly directed curl.

5. The thermally processable container and lid as defined in claim 1 wherein said inclined annular portion (9, 18, 30, 42, 46, 61, 74) in part defines an outwardly directed crushed curl.

6. The thermally processable container and lid as defined in claim 1 wherein said inclined annular portion (9, 18, 30, 42, 46, 61, 74) in part defines an inwardly projecting bead.

7. The thermally processable container and lid as defined in claim 1 wherein said inclined annular portion (9, 18, 30, 42, 46, 61, 74) in part defines an outwardly directed curl having a free edge sandwich between an uppermost exterior annular wall portion of said curl and a lowermost interior annular wall portion of said curl.

8. The thermally processable container and lid as defined in claim 1 wherein said inclined annular portion (9, 18, 30, 42, 46, 61, 74) is a separate ring (42), and means (38) for securing said separate ring (42) to said metal container body (40).

9. The thermally processable container and lid as defined in claim 1 wherein said inclined annular portion (9, 18, 30, 42, 46, 61, 74) is a separate metal ring (42), and means (38) for securing said separate metal ring (42) to said metal container body (40).

10. The thermally processable container and lid as defined in claim 1 wherein said inclined annular portion (9, 18, 30, 42, 46, 61, 74) is a separate plastic ring (42), and means (38) for securing said separate plastic ring (42) to said metal container body (40).

11. The thermally processable container and lid as defined in claim 1 wherein said side wall portion (7, 14, 29, 50, 64, 78) includes a reduced diameter neck (80), and said inclined annular portion (74) of the side wall projects outwardly and downwardly relative to said mouth.

12. The thermally processable container and lid as defined in claim 1 wherein said side wall portion (7, 14, 29, 50, 64, 78) includes a reduced diameter neck (80), said inclined annular portion (74) of the side wall projects outwardly and downwardly relative to said mouth, and said inclined annular portion (74) terminates in an inwardly directed curl.

13. The thermally processable container and lid as defined in claim 1 wherein bonded and sealed relationship between the inclined peripheral annular flange (3, 12, 25, 34, 54, 59, 72) and the inclined annular portion (9, 18, 30, 42, 46, 61, 74) is peelable.

14. The thermally processable container and lid as defined in claim 1 including a pull-tab (67) extending laterally from said peripheral annular flange (3, 12, 25, 34, 54, 59, 72).

15. The thermally processable container and lid as defined in claim 1 wherein said lid (1, 10, 21, 31, 31A, 52, 55, 71) is a laminate of several layers of plastic materials to achieve desired barrier characteristics.

16. A thermally processed sealed container which has been subject to elevated pressures during processing comprising a metal container body (8, 13, 28, 40, 70) containing a thermally processed product and being defined by a side wall portion (7, 14, 29, 50, 64, 78) from one end of which extends an inclined annular portion (9, 18, 30, 42, 46, 61, 74) defining a mouth of the container body (8, 13, 28, 40, 70), a lid (1, 10, 21, 31, 31A, 52, 55, 71) comprising a generally transversely extending central panel portion (2, 11) surrounded by a downwardly inclined peripheral annular flange (3, 12, 25, 34, 54, 59, 72) which is bonded and sealed to said inclined annular portion (9, 18, 30, 42, 46, 61, 74), said annular flange (3, 12, 25, 34, 54, 59, 72) of the lid (1, 10, 21, 31, 32A, 52, 55, 71) being inclined at an angle of between 5° and 85° to the central panel portion (2, 11) in order to cooperate with the annular portion (9, 18, 30, 42, 46, 61, 74) of the side wall, said thermal processed product having been thermally processed under elevated temperature after the container has been sealed thereby creating internal pressure in the sealed container causing said central panel portion (2, 11) to be temporarily upwardly deformed and subsequently returned to its original shape after thermal processing of said thermally processed product, and the upward deformation of said central panel portion (2, 11) during thermal processing of said thermally processed product effects a 10% increase in volume of the sealed container so as to limit increase in pressure internally of the container to no more than 5 p.s.i.

17. The thermally processed sealed container product and lid as defined in claim 16 wherein the angle between the annular flange (3, 12, 25, 34, 54, 59, 72) of the lid (1, 10, 21, 31, 31A, 52, 55, 71) and an axis extending perpendicular to the central panel portion (2, 11) is in a range substantially between 120° and 150°.

18. The thermally processed sealed container product and lid as defined in claim wherein said inclined annular portion (9, 18, 30, 42, 46, 61, 74) is inwardly upwardly inclined.

19. The thermally processed sealed container, product and lid as defined in claim 16 wherein said inclined annular portion (9, 18, 30, 42, 46, 61, 74) in part defines an outwardly directed curl.

20. The thermally processed sealed container, product and lid as defined in claim 16 wherein said inclined annular portion (9, 18, 30, 42, 46, 61, 74) in part defines an outwardly directed crushed curl.

21. The thermally processed sealed container, product and lid as defined in claim 16 wherein said inclined annular portion (9, 18, 30, 42, 46, 61, 74) in part defines an inwardly projecting bead.

22. The thermally processed sealed container, product and lid as defined in claim 16 wherein said inclined annular portion (9, 18, 30, 42, 46, 61, 74) in part defines an outwardly directed curl having a free edge sandwich between an uppermost exterior annular wall portion of said curl and a lowermost interior annular wall portion of said curl.

23. The thermally processed sealed container, product and lid as defined in claim 16 wherein said inclined annular portion (9, 18, 30, 42, 46, 61, 74) is a separate ring (42), and means (38) for securing said separate ring (42) to said metal container body (40).

24. The thermally processed sealed container product and lid as defined in claim 16 wherein said inclined annular portion (9, 18, 30, 42, 46, 61, 74) is a separate metal ring (42), and means (38) for securing said separate metal ring (42) to said metal container body (40).

25. The thermally processed sealed container, product and lid as defined in claim 16 wherein said inclined annular portion (9, 18, 30, 42, 46, 61, 74) is a separate plastic ring (42), and means (38) for securing said separate plastic ring (42) to said metal container body (40).

26. The thermally processed sealed container, product and lid as defined in claim 16 wherein said side wall portion (7, 14, 29, 50, 64, 78) includes a reduced diameter neck (80), and said inclined annular portion (74) of the side wall projects outwardly and downwardly relative to said mouth.

27. The thermally processed sealed container, product and lid as defined in claim 16 wherein said side wall portion (7, 14, 29, 50, 64, 78) includes a reduced diameter neck (80), said inclined annular portion (74) of the side wall projects outwardly and downwardly relative to said mouth, and said inclined annular portion (74) terminates in an inwardly directed curl.

28. The thermally processed sealed container, product and lid as defined in claim 16 wherein bonded and sealed relationship between the inclined peripheral annular flange (3, 12, 25, 34, 54, 59, 72) and the inclined annular portion (9, 18, 30, 42, 46, 61, 74) is peelable.

29. The thermally processed sealed container, product and lid as defined in claim 16 including a pull-tab (67) extending laterally from said peripheral annular flange (3, 12, 25, 34, 54, 59, 72).

30. The thermally processed sealed container, product and lid as defined in claim 16 wherein said lid (1, 10, 21, 31, 31A, 52, 55, 71) is a laminate of several layers of plastic materials to achieve desired barrier characteristics.

* * * * *